US007203974B2

(12) United States Patent
Jones et al.

(10) Patent No.: US 7,203,974 B2
(45) **Date of Patent: *Apr. 17, 2007**

(54) SCRUBS FORMED FROM WATER-SOLUBLE POLYMERIC MATERIAL

(75) Inventors: Joan Adell Jones, Lawrenceville, GA (US); John B. Steward, McKinney, TX (US)

(73) Assignee: Microtek Medical Holdings, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/853,324

(22) Filed: May 25, 2004

(65) Prior Publication Data

US 2004/0216217 A1 Nov. 4, 2004

Related U.S. Application Data

(62) Division of application No. 10/853,324, filed on May 25, 2004, which is a division of application No. 10/369,170, filed on Feb. 18, 2003, now Pat. No. 6,854,135.

(60) Provisional application No. 60/431,590, filed on Dec. 6, 2002.

(51) Int. Cl.
*A41D 13/00* (2006.01)
*A62B 17/00* (2006.01)

(52) U.S. Cl. ..... 2/456; 2/457; 2/69; 2/81; 2/227; 2/247

(58) Field of Classification Search ..... 2/456, 2/457, 458, 227, 247, 46, 69, 79, 81; 976/DIG. 376; 588/6

See application file for complete search history.

(56) References Cited

U.S. PATENT DOCUMENTS

| | | | | |
|---|---|---|---|---|
| 3,950,789 | A | 4/1976 | Konz et al. | |
| 4,033,354 | A | 7/1977 | De Rosa | |
| D292,140 | S | 10/1987 | Cahill et al. | |
| 4,738,119 | A | 4/1988 | Zafred | |
| D305,700 | S | 1/1990 | Werner | |
| 4,902,558 | A | 2/1990 | Henriksen | |
| 5,024,851 | A * | 6/1991 | Goad et al. | 427/2.3 |
| 5,181,967 | A | 1/1993 | Honeycutt | |
| 5,487,189 | A * | 1/1996 | Bell | 2/79 |
| 5,511,246 | A | 4/1996 | Farkas et al. | |
| D384,788 | S | 10/1997 | Curry | |
| 5,780,098 | A | 7/1998 | Battles | |
| 5,869,193 | A * | 2/1999 | Langley | 428/520 |
| 5,931,971 | A * | 8/1999 | Zucker | 8/137 |
| RE36,399 | E | 11/1999 | Honeycutt | |

(Continued)

FOREIGN PATENT DOCUMENTS

| | | |
|---|---|---|
| DE | 4132804 | 10/1992 |

(Continued)

OTHER PUBLICATIONS

Wikipedia.Com; Scrubs, History of Scrubs.*

Japanese Abstract No. 11-140762, Atsuo et al., "Production of Hot Water-Soluble Nonwoven Fabric", May 25, 1999.

*Primary Examiner*—Robert H. Muromoto
(74) *Attorney, Agent, or Firm*—Withers & Keys, LLC

(57) ABSTRACT

Water-soluble products and methods of making and using water-soluble products are disclosed.

20 Claims, 2 Drawing Sheets

U.S. PATENT DOCUMENTS

| | | | |
|---|---|---|---|
| D453,055 | S | 1/2002 | Ode |
| 6,341,384 | B1 | 1/2002 | Hayes |
| D456,115 | S | 4/2002 | Johnston |

FOREIGN PATENT DOCUMENTS

| | | | | |
|---|---|---|---|---|
| DE | 44 19 715 | A1 | | 12/1995 |
| JP | 11-140762 | | | 5/1999 |
| JP | 11140762 | A | * | 5/1999 |
| WO | WO 01/36338 | | | 5/2001 |

* cited by examiner

SCRUBS FORMED FROM WATER-SOLUBLE POLYMERIC MATERIAL

CROSS-REFERENCE TO RELATED APPLICATIONS

This patent application is a divisional patent application of U.S. patent application Ser. No. 10/853,324 filed on May 25, 2004, which is a divisional patent application of U.S. patent application Ser. No. 10/369,170 filed on Feb. 18, 2003, now U.S. Pat. No. 6,854,135, which claims the benefit of priority to U.S. provisional patent application Ser. No. 60/431,590 entitled "WATER-SOLUBLE PRODUCTS AND METHODS OF MAKING AND USING THE SAME" filed on Dec. 6, 2002, the subject matter of all of which is incorporated herein in its entirety.

FIELD OF THE INVENTION

The present invention relates to water-soluble products for use in industry. The present invention further relates to methods of making and using water-soluble products.

BACKGROUND OF THE INVENTION

During the twentieth century, international treaties, congressional acts, and executive orders have resulted in a number of regulations controlling all aspects of the environment and health and safety practices in the workplace. In particular, the disposal of industrial waste has been heavily regulated. Landfills nationwide have been closed and industry has been forced to turn to using alternatives such as conservation, recycling and incineration. A representative example is the medical industry, which generates millions of pounds of waste each year. Much of the generated waste is related to the use of disposable materials, such as personal protective clothing, equipment, and accessories necessary for patient care. These disposable materials become contaminated with bloodborne pathogens and are therefore unsafe for reuse. To prevent the spread of disease, these materials are typically discarded after a single use.

In addition, the nuclear industry also generates millions of pounds of waste each year. In the nuclear industry, much of the waste is similarly related to the use of disposable materials such as personal protective clothing, bags, mop heads, wipes, and other accessories that become contaminated by radioactive material, and become unsafe or impractical for reuse. The waste disposal and landfilling practices of the nuclear industry are highly regulated, and nuclear burial ground space is limited.

Various other industries also generate waste streams with similar characteristics. In seeking alternatives to landfilling and incineration, single-use, water-soluble products have been developed. These products provide desirable protection against contaminants, but are limited to a single use due to safety concerns and structural integrity.

Efforts continue to efficiently and effectively handle waste and other contaminants in various industries. There exists a need in the art of effective methods and products for handling and minimizing waste and contaminants from industries, such as the medical and nuclear industries.

SUMMARY OF THE INVENTION

The present invention addresses some of the difficulties and problems discussed above by the discovery of limited reusable products, which may be laundered and reused after laundering a number of times. Although the limited reusable products contain water-soluble material, the limited reusable products maintain structural integrity during multiple washing cycles so that the product may be reused between washing cycles. Further, the limited reusable products are virtually contaminant-free after washing due to their ability to release contaminants during the washing process. The limited reusable products may be used in an unlimited number of industries and applications, and find particular usefulness in the medical and nuclear industries.

The present invention is further directed to methods of making and using the limited reusable products. In one exemplary method, the limited reusable products are used for a particular purpose, washed to substantially remove any contaminants on or in the product due to such use, and then reused for the same particular purpose or a different purpose. After experiencing a number of washing cycles, the limited reusable products are disposed of by solubilizing the water-soluble material of the limited reusable product.

The present invention is also directed to methods of removing one or more contaminants from a product containing water-soluble material, wherein the method comprises washing the product in an aqueous bath under washing condition such that the water-soluble material does not become soluble. The method may comprise a number of additional steps including drying the washed product. In one exemplary embodiment of the present invention, the method is used to remove one or more contaminants from a coverall, such as a coverall used in the nuclear industry.

The present invention is even further directed to methods of reducing an amount of radioactive waste generated by at least one contaminated product, wherein the method comprises (a) washing the at least one contaminated product in an aqueous bath under washing condition such that the at least one product does not become soluble; and (b) washing the at least one contaminated product in an aqueous bath under washing condition such that at least a portion of the product becomes soluble. The exemplary method may comprise a number of additional steps including drying the washed product after washing step (a), and reusing the washed product. In one exemplary embodiment of the present invention, the method is used to reduce the amount of radioactive waste generated by contaminated protective clothing, such as coveralls.

In addition to limited reusable products and methods of using the same, the present invention is also directed to new single-use products and methods of using new single-use products in a variety of applications.

These and other features and advantages of the present invention will become apparent after a review of the following detailed description of the disclosed embodiments and the appended claims.

DETAILED DESCRIPTION OF THE INVENTION

Figure 1A:
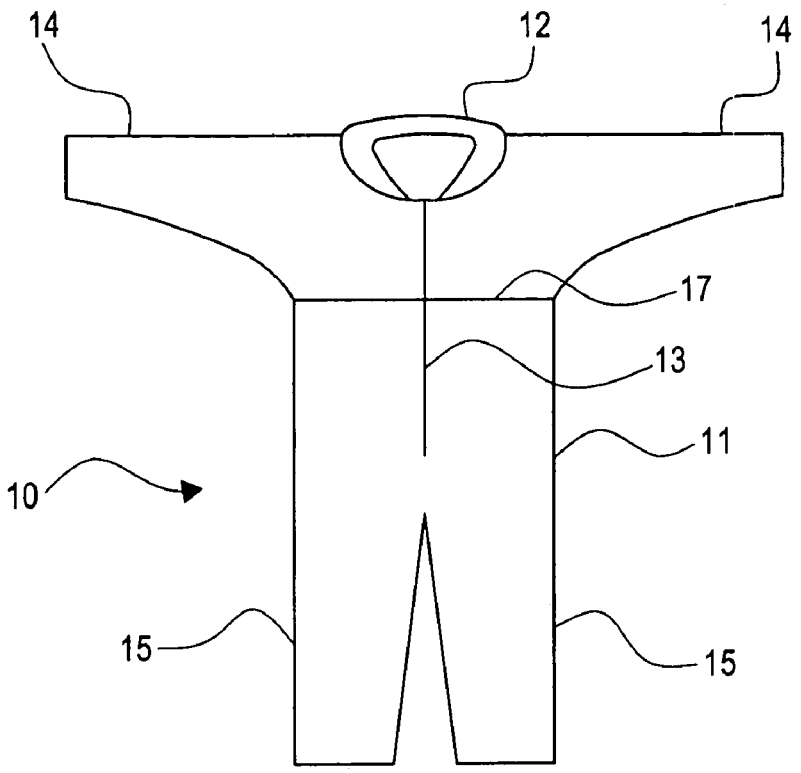
FIG. 1A depicts a frontal view of an exemplary coverall of the present invention.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to water-soluble products and methods of using the water-soluble products.

I. Launderable Products Containing Water-Soluble Material

The present invention is directed to launderable products containing water-soluble or water-dispersible material. Suitable products include, but are not limited to, fibers, fabrics, films, non-woven fabrics, woven fabrics, knitted fabrics, garments, protective clothing, scrubs, coveralls, booties, face masks, gloves, apparel, linens, drapes, towels, laminates containing at least one fabric or film, sponges, mop heads, webs, bags, gauze, pads, wipes, pillows, bandages, or a combination thereof. In one desired embodiment of the present invention, the launderable product comprises one or more pieces of protective clothing, such as scrubs, coveralls, booties, face masks, and gloves.

The launderable products contain water-soluble with or without water-insoluble material. As used herein, the term "water-soluble" refers to materials having a degree of solubility in water at a water temperature of 37° C. or above. When the launderable product contains both water-soluble and water-insoluble material, the combined materials are configured so that the mixture is "water-dispersible." As used herein, the term "water-dispersible" refers to a composite material, which typically contains water-soluble material in combination with water-insoluble material, and is capable of forming a dispersion in an aqueous bath at or above ambient temperature (about 20° C.) and, in some cases, in an aqueous bath at or above ambient temperature (about 20° C.) and having a pH of above 7.0.

Suitable water-soluble materials for use in the present invention include, but are not limited to, polyvinyl alcohol; polyacrylic acid; polymethacrylic acid; polyacrylamide; water-soluble cellulose derivatives such as methyl celluloses, ethyl celluloses, hydroxymethyl celluloses, hydroxypropyl methyl celluloses, and carboxymethyl celluloses; carboxymethylchitin; polyvinyl pyrrolidone; ester gum; water-soluble derivatives of starch such as hydroxypropyl starch and carboxymethyl starch; and water-soluble polyethylene oxides. Suitable alkali water-soluble materials for use in the present invention include, but are not limited to, ethylene copolymers of acrylic acid (EAA) and methacrylic acid (EMAA), and salts thereof; and ionomers containing acrylic acid and/or methacrylic acid. Desirably, the water-soluble material comprises polyvinyl alcohol with or without acetyl groups, cross-linked or uncross-linked. Suitable polyvinyl alcohol materials are described in U.S. Pat. Nos. 5,181,967; 5,207,837; 5,268,222; 5,620,786; 5,885,907; 5,891,812; the disclosures of all of which are hereby incorporated in their entirety by reference.

Suitable water-insoluble materials for use in the present invention include, but are not limited to, polyurethane resin, ion exchange resins, sodium polyacrylate, polymaleic acid, ammonium polyacrylate, microbial polyesters, polyhydroxybutyrate, polyhydroxybutyrate-valerate, polyhydroxyalkanoates, polyesters, polyglycolic acid, polyhydroxy acids, aliphatic polyesters, aromatic polyesters, aliphatic-aromatic copolyesters, aliphatic polyetheresters, aromatic polyetheresters, aliphatic-aromatic copolyetheresters, aliphatic polyesteramides, aromatic polyesteramides, aliphatic-aromatic copolyesteramides, aliphatic polyetherester amides, aromatic polyetherester amides, aliphatic-aromatic copolyetherester amides, polyethylene terephthalate, cellulose acetates, polycaprolactone, starch, starch blends, or mixtures thereof, polystyrene, nylon, polyester, polyolefin, polypropylene, polycarbonate, acrylonitrile butadiene styrene, polyethylene, ethylene vinyl acetate copolymer, ethylene methacrylate copolymer, ethylene olefin copolymer, cotton, rayon, cellulose or a mixture.

The launderable products may contain any of the above-described water-soluble materials alone or in combination with any of the above-described water-insoluble materials. Desirably, the construction of the launderable product is such that the launderable product either (1) completely dissolves or (2) breaks up into small particles when exposed to conditions, which cause the water-soluble component of the launderable product to become soluble.

In some embodiments of the present invention, the launderable product comprises water-soluble material alone or in combination with water-insoluble material. When water-insoluble materials are used to form a launderable product of the present invention, desirably less than about 50 parts by weight (pbw) of water-insoluble material is used in combination with at least about 50 parts by weight (pbw) of water-soluble material to form the launderable product, based on a total parts by weight of the launderable product. More desirably, the launderable product comprises at least about 70 pbw of water-soluble material and less than about 30 pbw of water-insoluble material, even more desirably, at least about 90 pbw of water-soluble material and less than about 10 pbw of water-insoluble material, based on a total parts by weight of the launderable product.

In a further embodiment, the launderable product consists essentially of water-soluble material. In yet a further embodiment, the launderable product consists of water-soluble material.

In one embodiment, the launderable product is a nonwoven fabric formed from spunbonded polyvinyl alcohol fibers. Alternatively, the nonwoven fabric may be formed by melt-blowing polyvinyl alcohol fibers. In still a further embodiment, the nonwoven fabric may be formed by dry carding and hydroentangling the polyvinyl alcohol fiber. In yet another embodiment, the nonwoven fabric may be formed by thermally bonding the fiber. In addition, the fabric may be formed by dry laying the fiber. In yet another embodiment, after dry laying, the fiber may be carded to produce a more uniform distribution of fibers and then needle-punched to enhance the strength of the fabric. Finally, after carding and needle-punching, the fibers may, optionally, be thermobonded. In still a further embodiment, the nonwoven fabric can be formed by chemical bonding the fibers.

In still a further embodiment, the launderable product is a woven fabric formed by weaving polyvinyl alcohol fibers. In yet another embodiment, the launderable product is a knitted fabric formed by knitting polyvinyl alcohol fibers. Any known technique for knitting and/or weaving fibers may be employed to form the launderable products.

In further desired embodiments of the present invention, the launderable product comprises at least one fabric layer, at least one film layer, or a combination thereof, wherein each of the layers comprises, consists essentially of, or consists of polyvinyl alcohol (PVA). The polyvinyl alcohol may be in fibrous form or film form. Suitable PVA fibers and films and methods of making PVA fibers and films are disclosed in U.S. Pat. Nos. 5,181,967; 5,207,837; 5,268,222; 5,620,786; 5,885,907; 5,891,812; the disclosures of all of which are hereby incorporated in their entirety by reference. An example of a suitable polyvinyl alcohol fiber for use in the present invention is a polyvinyl alcohol homopolymer that has been highly crystallized by post-drawing or by heat annealing.

Figure 1B:
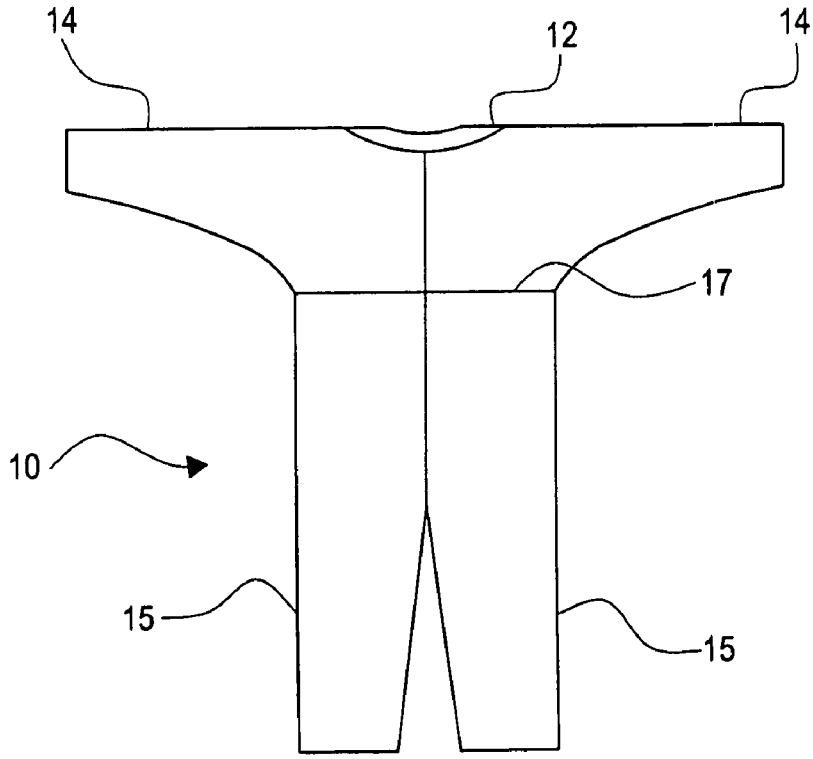
FIG. 1B depicts a rear view of the exemplary coverall of FIG. 1A.

In one desired embodiment of the present invention, the launderable product comprises a multiple-use, launderable coverall comprising water-soluble material. As used herein, the term "coverall" refers to a garment, which covers substantially all of a human body. An exemplary coverall is shown in FIGS. 1A and 1B. As shown in FIGS. 1A and 1B, exemplary coverall 10 comprises one or more sheet materials 11, collar 12, closure system 13, sleeves 14, pant legs 15, and one or more seams 17 for connecting separate sheet materials 11 to one another. FIG. 1A depicts a frontal view of exemplary coverall 10, while FIG. 1B depicts a rear view of exemplary coverall 10. Coverall 10 covers substantially all of a wearer's body (not shown) except for the wearer's hands, feet and head. In some cases, coverall 10 may include additional components for covering a wearer's hands (e.g., gloves), feet (e.g., booties) and/or head (e.g., hood). The additional components may be integrally connected to the coverall or may be attachable to the coverall.

The launderable coverall may be sold as an unwashed garment or as a pre-washed garment. As used herein, the term "pre-washed" is used to describe garments (i) that have been washed at least one time, typically, only one time, and (ii) that have not yet been used for a particular purpose (i.e., the product has not been exposed to contaminants). The launderable coverall is desirably capable of being washed in an aqueous bath (under washing condition such that the water-soluble material does not become soluble as described below) up to about 20 times without negatively impacting the structural integrity of the coverall. Typically, the launderable coverall is washed up to about 10 times before disposing of the launderable coverall.

The launderable coverall desirably comprises polyvinyl alcohol with or without acetyl groups, cross-linked or uncross-linked. The launderable coverall may consist essentially of water-soluble material, or may consist of water-soluble material. The coverall may comprise one or more of the following components: (a) two or more fabric and/or film sheets joined to one another with (b) one or more sheet fastening devices; (c) a closure system used to connect adjacent sheets of fabric and/or film material to one another; one or more pockets; and (e) an optional wash marker indicator, which indicates the number of wash cycles that the coverall has experienced. Suitable fabric and/or film sheets include, but are not limited to, nonwoven fabric sheets, woven fabric sheets, knitted fabric sheets, film sheets, and combinations thereof. Suitable sheet fastening devices include, but are not limited to, thread, adhesives, hoop and loop materials, or a combination thereof. Suitable closure systems include, but are not limited to, one or more zippers, drawstrings, snaps, buttons, adhesives, hoop and loop materials, or a combination thereof. Suitable wash marker indicators include, but are not limited to, a detachable strip of coverall material.

Figure 2A:
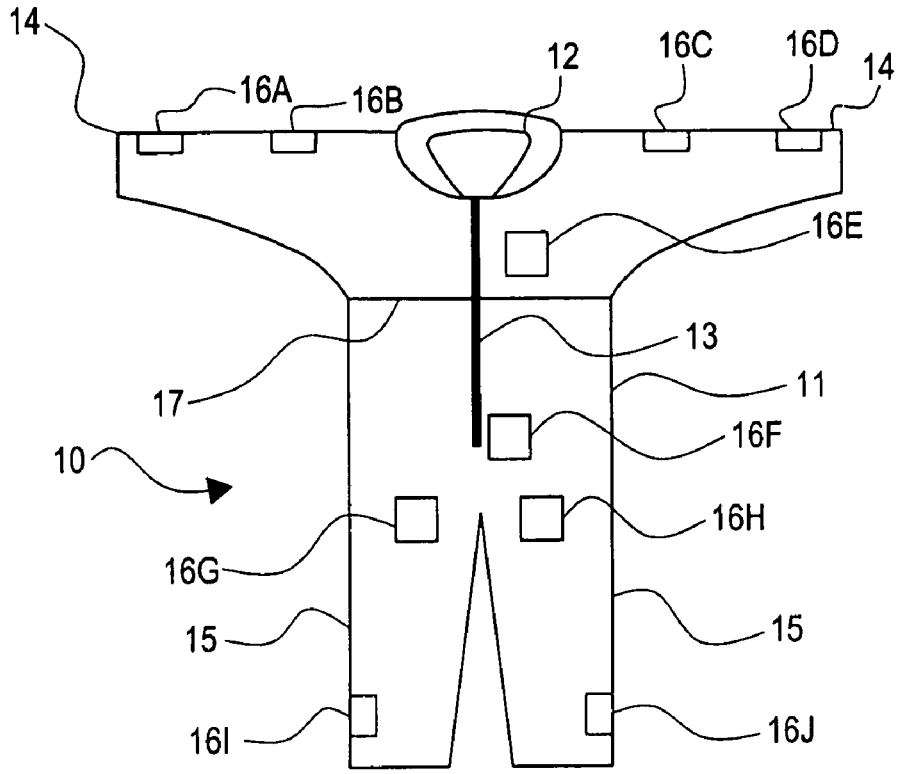
FIG. 2A depicts a frontal view of an exemplary dosimetry coverall of the present invention.
Figure 2B:
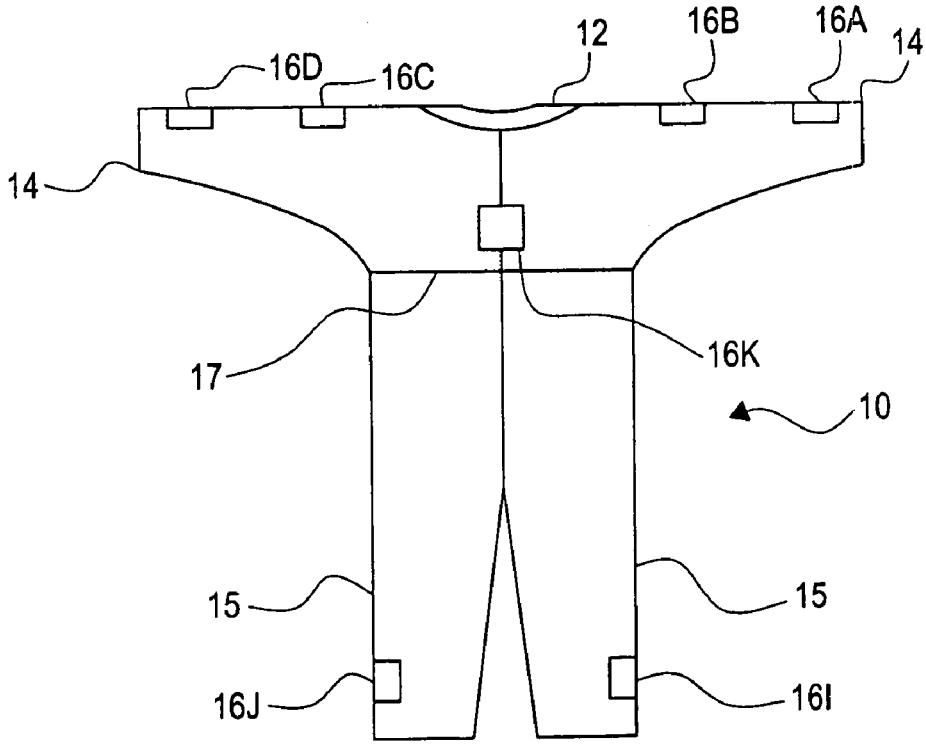
FIG. 2B depicts a rear view of the exemplary dosimetry coverall of FIG. 2A.

The launderable coverall may be pocketless or may comprise one or more pockets. Typically, the launderable coverall comprises up to about 15 pockets. One or more of the pockets may have a flap closure to close the pocket. In one embodiment of the present invention, the launderable coverall may comprise 11 pockets for dosimetry use. An exemplary launderable dosimetry coverall is depicted in FIGS. 2A and 2B. As shown in FIG. 2A, exemplary dosimetry coverall 10 comprises one or more sheet materials 11, collar 12, closure system 13, sleeves 14, pant legs 15, pockets 16*a*–16*k* (pocket 16*k* is shown in FIG. 2B), and one or more seams 17 for connecting separate sheet materials 11 to one another. Pockets 16*a*–16*k* are located in the following locations: pockets 16*a*–16*d* are located along sleeves 14; pocket 16*e* is located in the chest area of coverall 10; pocket 16*f* is located in the groin area of coverall 10; pockets 16*g*–16*h* are located along an upper part of pant legs 15; and pockets 16*i*–16*j* are located along a lower part of pant legs 15. As shown in FIG. 2B, pocket 16*k* is located along the back of coverall 10.

Desirably, the launderable coverall and all of its components (i.e., sheets, sheet fastening devices, closure systems, wash marker indicators, and pockets) comprise water-soluble material, water-dispersible material, or a combination thereof. More desirably, the coverall and all of its components consists essentially of water-soluble material or water-dispersible material. Even more desirably, the coverall and all of its components consist of water-soluble material or water-dispersible material.

The launderable coverall may be pre-treated with a chemical treatment to enhance one or more properties selected from impermeability, permeability, flame resistance, moisture vapor permeability, tear strength, and stain resistance.

The launderable coverall may be colorless, dyed or printed using conventional dyes and/or colorants. In one embodiment, at least a portion of the launderable coverall is dyed or printed.

As discussed above, the launderable coverall may further comprise at least one of an integral hood, integral booties, integral gloves, or a combination thereof.

II. Methods of Washing Products Containing Water-Soluble Material

The present invention is also directed to methods of removing one or more contaminants from a product containing water-soluble material, wherein the method comprises washing the product in an aqueous bath under washing condition such that the water-soluble material does not become soluble. The method may be used to remove one or more contaminants from any of the above-described products. The method finds particular utility in the medical and nuclear industries for removing contaminants, such as biohazardous or radioactive waste from a protective garment.

The method may include two or more washing steps, wherein the product is used repeatedly between washing steps. Desirably, the product may be reused and washed up to about 20 times. In some exemplary embodiments of the present invention, the product is used a limited number of times (i.e., reused and washed a limited number of times). In some cases, the product is reused and washed up to about 10 times.

The washing step may be performed using commercially available washing machines. Suitable washing machines include, but are not limited to, washing machines available from Pellerin Milnor Corporation (Kenner, La.). Examples of suitable washing machines include, but are not limited to, washing machines available from Pellerin Milnor Corporation having a desired load capacity. Desirably, the washing machine has a load capacity (i.e., weight of garments, not garments with water) of at least about 45 kilograms (kg) (100 lbs.), more desirably, at least about 113 kilograms (kg) (250 lbs.), even more desirably, at least about 227 kilograms (kg) (500 lbs.).

The washing step is performed under conditions such that the water-soluble material does not become soluble. Desirably, the aqueous bath has a bath temperature of less than about 90° C. during the washing step. More desirably, the aqueous bath has a bath temperature of less than about 75° C., even more desirably, less than about 50° C., and even more desirably, less than about 37° C. during the washing step. In one desired embodiment of the present invention, the aqueous bath has a bath temperature of about 15° C. during the washing step.

The washing step uses an aqueous bath. The aqueous bath may comprise water alone or in combination with one or more additional components. In addition to water, the aqueous bath may include one or more additional components including, but not limited to, surfactants, detergents or other cleaning agents. Commercially available detergents may be used in the washing step. An example of a suitable surfactant is E-500 commercially available from Paragon Corporation (Birmingham, Ala.). An example of a suitable detergent is ASSERT brand detergent, also commercially available from Paragon Corporation (Birmingham, Ala.).

The method of removing one or more contaminants from a product containing water-soluble material is suitable for removing a variety of contaminants. Exemplary contaminants include, but are not limited to, radioactive material, infectious waste, bio-hazardous waste, industrial waste containing petroleum-based contaminants, or a combination thereof. As used herein, the term "radioactive material" includes, but is not limited to, a transuranic element, a fission product, a natural radioactive element, an activation product from a nuclear process, a medical isotope, or a combination thereof.

The method of removing one or more contaminants from a product containing water-soluble material may comprise one or more additional steps in addition to the above-described washing step. Suitable additional steps include, but are not limited to, soaking and/or agitating the product or aqueous bath during the washing step; dry cleaning the product; extracting water from the product; drying the product; monitoring the product to detect the presence of one or more contaminants (e.g., radioactive material); and marking the product in some manner to identify how many washing cycles the product has experienced. For example, the step of monitoring a washed product to detect the presence of one or more contaminants is a standard procedure in the nuclear industry. Suitable marking steps include, but are not limited to, removing a detachable portion of the product, punching a hole in the product corresponding to the number of washed, and applying a tag to the product.

Once the product is washed, the product is further processed to remove water from the product. In one exemplary method, the product is centrifuged in a commercial centrifuge apparatus at a centrifugal force of from about 200 to about 220 g for a period of time to remove excess water from the product. Typically, the product is centrifuged in such an apparatus for about 2 to about 4 minutes to remove excess water from the product. The product may be centrifuged in a separate commercial apparatus or may be centrifuged in the above-mentioned washing machines.

After a centrifuge step, the product may be dried in a commercial dryer. Suitable commercial dryers include, but are not limited to, commercial dryers available from Cissell Manufacturing Company (Louisville, Ky.) and having a load capacity similar to the commercial washing machines described above. Desirably, the product is dried at a drying temperature of at least 38° C. (100° F.) for a sufficient time to remove residual water. Drying temperatures may be greater than 38° C. (100° F.), such as at least 49° C. (120° F.), at least 60° C. (140° F.), at least 71° C. (160° F.), at least 91° C. (195° F.), and as high as 104° C. (220° F.). Drying times may be greater than 30 minutes at lower temperatures, such as temperatures less than about 60° C. (140° F.). At higher temperatures, the drying time may be below 30 minutes. Desirably, the drying time is less than about 20 minutes, and as little as 10 minutes.

In one embodiment of the present invention, the method of removing one or more contaminants from a product containing water-soluble material comprises (i) washing the product in an aqueous bath under washing condition such that the water-soluble material does not become soluble; (ii) optionally, agitating the fibric or aqueous bath during the washing step; (iii) extracting water from the washed product (e.g., centrifuging the product); (iv) drying the washed product; (v) using the washed product for a particular purpose, wherein the particular purpose exposes the washed product to one or more contaminants; and (vi) repeating steps (i) to (v) as needed.

One desired embodiment of the present invention is a method of removing one or more contaminants from a coverall containing water-soluble material, wherein the method comprises washing the coverall in an aqueous bath under washing condition such that the water-soluble material does not become soluble. The method may further comprise any of the above-mentioned method steps, such as water extraction (centrifuge) and drying the washed coverall. Desirably, the method of removing one or more contaminants from a coverall comprises two or more of the above-mentioned washing/water extraction/drying steps, and as many as 20 of the above-mentioned washing/water extraction/drying steps. Desirably, the coverall comprises polyvinyl alcohol with or without acetyl groups, cross-linked or uncross-linked.

The above-described method of removing one or more contaminants from a coverall containing water-soluble material is useful in a variety of applications, and is particularly useful in the nuclear or medical industry, wherein the one or more contaminants comprise radioactive waste, infectious waste, bio-hazardous waste, or a combination thereof.

III. Washed Products Containing Water-Soluble Material

As discussed above, the launderable coverall may be pre-washed (i.e., a launderable coverall washed at least once, but not yet used for a particular purpose or exposed to contaminants) using a method as described above. The pre-washed launderable coverall is substantially free of lint and static. Further, the pre-washed launderable coverall is free of substantial shrinkage during subsequent washing/drying cycles. During the initial wash/dry cycle, the materials used to form the launderable coverall may shrink as much as 20%. For example, launderable coveralls formed from spunlaced nonwoven fabrics of PVA fibers typically have a shrinkage of up to about 16% during an initial wash/dry cycle. Such initial shrinkage drastically changes the original size (i.e., the size before washing) of the launderable coverall, which potentially causes problems for the user. In order to avoid these potential problems, (i) the launderable coverall itself is either pre-washed or (ii) the sheets of material used to form the launderable coverall are pre-shrunk (i.e., washed/dried) prior to being incorporated into the launderable coverall.

Shrinkage within a coverall may be measured between any two points on the coverall. Typical ways to measure coverall shrinkage include measuring the amount of shrinkage in the following locations: (a) from the center of the back to the end of a sleeve; (b) along a leg inseam; (c) across the chest; and (d) from the back collar seam to the crotch. Other measurements include (e) from the end of one sleeve to the end of the other sleeve; and (f) from the back collar seam to the end of one leg inseam. Desirably, the pre-washed launderable coverall or the pre-shrunk launderable coverall has a cumulative shrinkage of less than about 10% in each of the above-described dimensions (a) to (f) during a second or subsequent washing cycle (i.e., up to 20 washing cycles). In other words, the pre-washed launderable coverall or the pre-shrunk launderable coverall has a shrinkage of less than about 10% in any and all of the dimensions (a) to (f) during the life of the coverall after the initial wash cycle. More desirably, the pre-washed launderable coverall or the pre-shrunk launderable coverall has a cumulative shrinkage of less than about 5% in each of the dimensions (a) to (f) during a second or subsequent washing cycle (i.e., up to 20 washing cycles).

The above-described method of removing one or more contaminants from a product containing water-soluble material results in a pre-washed or washed product, which is substantially free of contaminants. The pre-washed products may be used for the first time and reused after a second or subsequent washing. The washed products may be reused after washing. The reusable, pre-washed and washed products are desirable to workers due to their safe, substantially contaminant-free washed condition.

For example, in the nuclear industry, reusable cotton or cotton blend coveralls are washed and reused by workers. Reusable garments are monitored prior to reusing the product to minimize exposure of workers to radioactive material. A measurement of disintegrations per minute (dpm) is used to determine the degree of exposure to radioactive material. A laundry monitor, typically referred to as an "Automated Laundry Monitor" or "ALM", is used to measure the amount of residual radioactive contamination in disintegrations per minute or "dpm". Typically, the laundry monitoring step comprises a procedure, wherein a garment or other product is placed on a wire mesh conveyor belt having a width of about 150 to 180 cm. The garment is spread out on the conveyor belt, which passes between two sets of radiation detectors, with one row of detectors above the belt and another row of detectors below the belt. The detectors may be beta detectors, gamma detectors, or both. Alarm setpoints are set prior to processing each customers clothing. If an item alarms the detector, the item is removed and rewashed and monitored again. If the item fails the second monitoring step, the item is placed in a bag and marked as rejected and returned to a customer.

Currently, reusable cotton or cotton blend coveralls typically measure between about 50,000 to about 100,000 dpm on an ALM after washing and prior to reuse. The washed products of the present invention provide much lower measurements, which prior to the present invention, had not been achievable in the nuclear industry. The washed PVA coveralls of the present invention measure less than about 25,000 dpm on the same ALM. Desirably, the washed PVA coveralls of the present invention measure less than about 5,000 dpm on the same ALM, and more desirably, from about 1,000 dpm to about 5,000 dpm on the same ALM.

IV. New Single-Use Products Containing Water-Soluble Material

The present invention is also directed to new single-use products containing water-soluble material. In one exemplary embodiment, the present invention is directed to a single-use dosimetry coverall as shown in FIGS. 2A–2B and described above. In a further exemplary embodiment, the present invention is directed to single-use scrubs comprising water-soluble material, such as polyvinyl alcohol fibers. As used herein, the term "scrubs" refers to articles of clothing routinely used in the medical industry. The term "scrubs" includes in combination (i) a smock-like, shirt typically having a V-neck, short or long sleeves, and up to about six pockets, typically, one pocket, and (ii) a pair of pants having long or short pant legs, and up to about four pockets, typically, two pockets.

The single-use products of the present invention may comprise any of the above-mentioned water-soluble materials alone or in combination with water-insoluble materials. The single-use products desirably comprise at least 50 parts by weight (pbw) of water-soluble materials, based on a total weight of the single-use product as described above.

Desirably, the single-use dosimetry coverall and the single-use scrubs comprise at least 50 pbw of water-soluble materials, based on a total weight of the single-use product. More desirably, the single-use dosimetry coverall and the single-use scrubs consist essentially of water-soluble materials. Even more desirably, the single-use dosimetry coverall and the single-use scrubs consist solely of water-soluble materials.

In one desired embodiment, the single-use scrubs consist essentially of water-soluble materials and at least one colorant to provide a desired color to the scrubs, such as a blue or green color.

V. Methods of Disposing of the Products Containing Water-Soluble Material

The present invention is further directed to methods of disposing of any of the above-described multiple-use and single-use products containing water-soluble materials. The methods of disposing of the multiple-use and single-use products will depend on the types of contaminants present on the multiple-use or single-use product at the time of disposal. For example, if the contaminants are household dirt or unregulated materials, the method of disposing of the product may comprise a disposal step, wherein the product dissolves during the disposal step, and the remains of the product, if any, are discarded with the wash bath. Examples of suitable methods of this type of disposal are disclosed in U.S. Pat. Nos. 5,181,967 and 5,891,812; the disclosures of both of which are hereby incorporated in their entirety by reference. For other types of contaminants, such as contaminants in the medical and/or nuclear industries, the methods of disposing of the multiple-use and single-use products may comprise multiple steps in order to separate, and control the handling of the contaminants, as well as, the water-soluble materials of the multiple-use and/or single-use product.

When the one or more contaminants; comprise radioactive material, the method of disposing of the multiple-use or single-use product is desirably one of the methods disclosed in U.S. patent application Ser. No. 09/863,014, filed on May 23, 2001; International Publication No. WO 01/36338 corresponding to PCT Application No. PCT/US00/26553; and PCT Application No. PCT/US02/16184, filed on May 22, 2002; the disclosures of all of which are hereby incorporated in their entirety by reference. In these methods of disposal, the method may include one or more of the following steps:

(1) placing the multiple-use product into a disposal reactor;
(2) introducing water into the reactor to form a solution;
(3) adding a degradation-enhancing reactant or a precursor of a degradation-enhancing reactant to the solution;
(4) heating the aqueous solution so as to react the precursor to form the degradation-enhancing reactant, if necessary, and reacting with the water-soluble polymer to form degradation products;
(5) optionally, filtering non-solubilized material from the aqueous environment;
(6) optionally, measuring a parameter indicator of the concentration of polymer material in the aqueous environment;
(7) optionally, filtering material, e.g., radioactive material from the aqueous environment;
(8) optionally, altering, e.g., neutralizing, the pH of the aqueous environment;
(9) optionally, biodegrading the resulting degradation products in the aqueous environment, e.g., organic acids form $CO_2$, $H_2O$ and biomass; and
(10) removing any insoluble components from the reactor.

Suitable degradation-enhancing reactants or precursors thereof include, but are not limited to, oxidizing agents such as $H_2O_2$, $Fe^{+3}$, $Cu^{+2}$, $Ag^+$, $O_2$, $Cl_2$, $ClO^-$, $HNO_3$, $KMnO_4$, $K_2CrO_4$, $K_2Cr_2O_7$, $Ce(SO_4)_2$, $K_2S_2O_8$, $KIO_3$, ozone, peroxides, or any combination thereof. In embodiments employing hydrogen peroxide as an oxidizing agent, the concentration of the hydrogen peroxide can be at least 5%, 10%, 15%, 20%, 25%, 30%, 35%, 40%, 45%, 50%, 55%, 60%, 65%, 70%, 75%, 80%, 85%, 90%, or 95%. However, in a desired embodiment, the hydrogen peroxide used is commercially available 30–35% hydrogen peroxide. A specific example of hydrogen peroxide suitable for use in the present invention is commercially available as CAS No. 7722-84-1, and may be purchased from a number of sources including VWR Scientific Products, West Chester, Pa. 19380, Catalog No. VW 9742-1.

In one suitable embodiment, the method of diposal further comprises heating an aqueous solution containing the multiple-use product and/or single-use product and a degradation-enhancing reactant/precursor, e.g., oxidizing agent, at a temperature and length of time sufficient to dissolve the water-soluble polymer within the multiple-use product and/or single-use product and react the oxidizing agent. This may be accomplished by pressure-cooking the solution in a bath of high-temperature water at a constant volume, such as by autoclaving. The vessel containing the aqueous solution and multiple-use product and/or single-use product may be heated to a temperature in a range of between about 100° C. (212° F.) to about 121° C. (250° F.) under saturation pressure. Pressure-cooking the aqueous solution and multiple-use product and/or single-use product in this manner enables higher solution temperatures than can be achieved in ambient air without boiling. The higher temperature of the solution transfers more heat energy to the solid polymer material, and the increased heat energy more effectively penetrates solid masses of polymer materials to dissolve them completely. Further, the higher temperatures of the autoclave achieve a sterilization of the waste stream that cannot be achieved at lower temperatures. The high temperature used in pressure-cooking the water-soluble polymer solution is sufficient to cause chemical decomposition of the oxidizing agent, especially in the presence of up to 100 ppm of a Fenton Reagent. For example, when the oxidizing agent is hydrogen peroxide, the high temperature is sufficient to produce hydroxyl radicals, molecular oxygen or a combination of both. When up to 100 ppm of a Fenton Reagent is used in combination with hydrogen peroxide, the production of hydroxyl radicals, molecular oxygen or a combination of both and the degradation of polymer is greatly enhanced, decreasing the reaction time needed to degrade the polymer.

The aqueous contents of the reactor vessel are desirably filtered through strainers to remove any undissolved polymer material and water-insoluble polymer constituents in the solution. In a desired embodiment, the strainers will have a mesh size in an approximate range of between about 20 and about 50 mesh. In a more desired embodiment, the strainers will have a mesh size of approximately about 30 mesh. Undissolved polymer material trapped in the strainers may be recirculated for final solubilization. In a desired embodiment, polymer material will constitute an approximate range of greater than 0% to about 10.0% by weight in the solution. In a more desired embodiment, polymer material will constitute an approximate range of between about 4.0% to about 6.0% by weight in the solution. In still a more desired embodiment, polymer material will be present in an amount of about 5.0% by weight in the solution. Additionally, in the one desired embodiment, the temperature of the solution during the filtration process step is maintained at or above about 66° C. (150° F.) to prevent precipitation of the PVA out of solution prior to its destruction.

The polymer may be destroyed by a reaction, e.g., an oxidation-reduction reaction that converts the polymer material into new and uniquely different organic compounds that do not exhibit the same physical or chemical characteristics of the original polymer material. The characteristics of these compounds can be used to determine the extent of the reaction. This step is only necessary when it is necessary to determine the progress or completion of the destruction of the polymer material in the solution. For example, where the polymer is PVA and the degradation-enhancing reactant/precursor is hydrogen peroxide, the resultant solution will include water and organic acids, such as acetic acid. Thus, the pH of the resultant solution will decrease measurably during PVA oxidation. The degree of completion of the reaction can be measured by the decrease of the pH of the solution. A complete reaction (complete destruction of the PVA in solution) can be indicated by a pH below at least about 6.0, alternatively below at least 5.0, or even below at least 4.0; still alternatively below at least 3.0 or even below at lest 2.0. Similarly, the corresponding decrease in the pH can be between about 1.0 units to about 6.0 units below the pH of the solubilized solution. In an alternative embodiment, the desired decrease in pH is between about 2.7 units to about 3.9 units below the pH of the solubilized solution.

Alternatively, the destruction of PVA may be confirmed by colorimetric assay of the PVA concentration in solution. Measurement by calorimetric assay may also be done in combination with measurements of pH. Note Amended Assay by Joseph H. Finley, "Spectrophotometric Determination of Polyvinyl Alcohol in Paper Coatings," *Analytical Chemistry* 33(13) (December 1961), and the colorimetric iodine solutions taught therein, including a desired solution using 12.0 g boric acid, 0.76 g iodine and 1.5 g potassium iodide per liter. Desirably, spectrophotometric measurement of the polyvinyl alcohol occurs at its absorption maximum of 690 nm. The assay may be completed by: placing 20.0 ml colorimetric iodine solution in cuvette; adding 0.5 ml sample; incubating the solution at 25° C. for five minutes. Spectrophotometric measurement can be made at the absorption maximum, 690 nm using a Hach DR2010 or Odysey DR2500 spectrophotometer. Standard solutions of polyvinyl alcohol may be prepared and a standard curve prepared using up to 10.0% concentrations of PVA in solution. The calibration curve may be derived from the absorption values at 690 nm (at 25° C.) plotted against the quantity of PVA per assay.

In one embodiment, degradation of polymeric material in the solution may also be accomplished by irradiating the solution with electromagnetic radiation. This process step results in a photochemical reaction predetermined as photolysis. Photolysis is chemical decomposition by the action of radiant electromagnetic energy. Ultraviolet radiation is electromagnetic radiation in the wavelengths from about 4 nanometers (nm), to about 400 nm. In a desired embodiment, ultraviolet radiation between the wavelengths of approximately about 180 nm and about 250 nm is used. In this process step, the exposure of the hydrogen peroxide in the solution to electromagnetic energy in the wavelengths of ultraviolet radiation, results in the photolysis of the hydrogen peroxide into hydroxyl free radicals (HO.) as shown in the following equation:

$$H_2O_2+h\upsilon \rightarrow 2HO.$$

where "h" represents Planck's constant ($6.6261\times10^{-34}$ joule-second), and "υ" represents the frequency of the ultraviolet radiation. (HO.) is the hydroxyl free radical. The hydroxyl radicals present a very aggressive oxidizing environment in which the hydroxyl free radicals attack the organic constituents of the liquid stream, thereby initiating an oxidative cascade of reactions, including the complete destruction of the polymer material in solution. The components of the polymer material predominantly forms simple organic acids.

In another embodiment, degradation of polymeric material in the solution may be accomplished without irradiating the solution with electromagnetic radiation as described above. In this embodiment, at least one degradation-enhancing reactant/precursor, e.g., oxidizing agent, is added to the polymer-containing solution. The solution is then heated at a temperature in a range of between about 100° C. (212° F.) to about 121° C. (250° F.) under saturation pressure. The combination of heat, oxidizing agent (e.g., hydrogen peroxide), and optional catalyst (e.g., a Fenton Reagent) results in the production of hydroxyl radicals, molecular oxygen or both, which effectively degrades the polymer.

The disposal method may also include at least one filtering step when radioactive material is present in the solution. If the multiple-use product was exposed to radioactivity that affects the disposability of the solution, then this process step should be added. With the addition of this process step, a low-level radioactive waste management system is created. This waste management system can be used as an alternative approach to current dry active radioactive waste treatment methods.

The process step of removal of radioactivity typically occurs prior to biological degradation. A more detailed desired embodiment of this process step includes the basic steps of:

(a) filtration of the solution, and (b) ion exchange of the solution.

At nuclear facilities, radioactivity may be present in process fluids in both elemental and particulate form. Filtration of the solution removes radioactive particulates. In a desired embodiment, the solution is passed through a particulate filter having a nominal pore size ranging approximately between about 10 and about 100 microns. In a more desired embodiment, the solution is then passed through a second particulate filter having a nominal pore size ranging approximately between about 0.1 micron and about 1.0 micron.

An ion exchange step may be used to deplete the solubilized radioactive species, or solubilized elemental radioisotopes, that remain after microfiltration, making the solution suitable for disposal or further treatment. In a desired embodiment, the solution is directed through an ion exchange vessel that contains ion exchange resin in the form of anion, cation bed or a combination thereof. During this process step, radioactive ions in solution will exchange places with the non-radioactive ions attached to the resin in solid form. The radioactive material collects on the resin, leaving the solution suitable for discharge or reuse as desired.

In one embodiment, the resultant organic acid-containing solution is pH neutralized by addition of a base reagent. In a more desired embodiment, sodium hydroxide is the base reagent used to raise the pH to an approximate range of between about 3.0 and about 10.0. In another more desired embodiment, when the solution will be biologically treated such as described below, sodium hydroxide is the base reagent used to increase the pH to within an approximate range of between about 5.0 and about 8.0. It is believed that the sodium hydroxide combines with the acetate of the acetic acid in the solution to form a sodium acetate buffer, which is important to the biodegrading process step. In the most desired embodiment, the pH of the resultant organic acid-containing waste stream is neutralized to within an approximate range of between about 6.0 and about 7.0.

For the purposes of the present invention, the term "altering" refers to adjusting the pH while "neutralization" is intended to mean increasingly adjusting of the pH of an acidic solution to a more basic, less acidic, solution having a pH of approximately between about 3.0 and about 10.0.

The method may also include a step of removing dissolved arid colloidal organic carbon compounds that remain in the aqueous stream after oxidation. The neutralized solution of destroyed polymer material has a high carbon compound content that may render the solution unfit for discharge to sanitary sewer systems. Total organic carbon (TOC) is a direct measurement of the concentration of the organic material in solution. Biochemical oxygen demand (BOD) is a measure of the oxygen required for the total degradation of organic material and/or the oxygen required to oxidize reduced nitrogen compounds. Chemical oxygen demand (COD) is used as a measure of the oxygen equivalent of the organic matter content of a sample that is susceptible to oxidation by a strong chemical oxidant. One or more of these parameters are commonly used by publicly operated treatment facilities to regulate effluent waste streams.

Additionally, in instances where the polymer material may contain or have been exposed to radioactivity, it is possible that even after the microfiltration of particulate species and ion exchange depletion of the solubilized radioactive species, the neutralized solution may still contain a level of radioactive material such that the solution is undesirable for disposal or further treatment. Accordingly, depletion of the organic carbon material from solution can further deplete residual radioactive species contained in the neutralized solution.

Biodegradation of the organic acids and other organic products in the solution is therefore used to (1) deplete and/or remove organic carbon compounds; and (2) further aid in the depletion of residual radioactive material. In this process step, the neutralized solution is inoculated with microorganisms. The microorganisms utilize the organic acids produced by the oxidation-reduction of the water-soluble polymer material as a carbon and energy source. In a desired embodiment, the microorganisms are comprised substantially of aerobic, heterotrophic bacteria. These forms of bacteria are known to those in the art and are readily available. Treated-PVA Degradation Organisms may include:

*Arthrobacter ilicis*
*Bacillus amyloliquefaciens*
*Bacillus pumilus* GC subgroup B
*Bacillus subtilis*
*Brevibacterium mcbrellneri*
*Comamonas testosteroni*
*Flavobacterium resinovorum*
*Kocuria kristinae*
*Microbacterium liquefaciens*
*Micrococcus luteus* GC subgroup C
*Pseudomonas balearica*
*Pseudomonas chlororaphis*
*Pseudomonas putida* biotype A
*Pseudomonas pseudoalcaligenes*
*Rhodococcus equi* GC subgroup B All organisms may be purchased from Advanced Microbial Solutions, 801 Highway 377 South, Pilot Point, Tex. 76258. The following organisms may be purchased from the American Type Culture Collection, 12301 Parklawn Drive, Rickville, Md. 20852 (http:http//www.atcc.org):

*Arthrobacter ilicis*
*Bacillus amyloliquefaciens*
*Bacillus pumilus* GC subgroup B
*Bacillus subtilis*
*Brevibacterium mcbrellneri*
*Comamonas testosteroni*
*Flavobacterium resinovorum*
*Kocuria kristinae*
*Microbacterium liquefaciens*
*Micrococcus luteus* GC subgroup C
*Pseudomonas chlororaphis*
*Pseudomonas putida* biotype A
*Pseudomonas pseudoalcaligenes*
*Rhodococcus equi* GC subgroup B The aerobic, heterotrophic bacteria metabolize the organic acids in the solution, thus reducing the COD of the solution and rendering it dischargeable to sanitary sewer systems. A desired Experimental Growth medium used in treated-PVA experiments for a healthy and sustainable bacteria population, per liter $H_2O$ comprises:

| | |
|---|---|
| Acetic acid | 0.5% |
| Molasses | 0.002% |
| $(NH_4)_2SO_4$ | 1.0 g |
| $KH_2PO_4$ | 1.0 g |
| $KH_2PO_4$ | 0.8 g |
| $MgSO_4$ 7 $KH_2O$ | 0.2 g |
| NaCl | 0.1 g |
| $CaCl_2$ $2H_2O$ | 0.2 g |
| $FeSO_4$ | 0.01 g |
| $Na_2MoO_4$ $2H_2O$ | 0.5 mg |
| $MnSO_4$ | 0.5 mg |
| Yeast extract | 10.0 g |

Desirably, the pH is adjusted to within the approximate range of about 3.0 to about 10.0 prior to the biodegradation step. In a more desired embodiment, it is recommended to adjust the pH to about 7.5 and growing organisms at 25° C. In a more desired embodiment, the solution is directed to a pulverized activated carbon (PAC) chamber comprising an aerated, fluidized bed of PAC. The pulverized carbon becomes a suspended substrate for bacterial growth. When the TOC is reduced to the desired level below local regulatory limitations, the biologically treated solution can be decanted and released for discharge.

VI. Methods of Reducing Radioactive Waste

The present invention is further directed to methods of reducing an amount of radioactive waste generated by at least one contaminated product, wherein the method comprises (a) washing the at least one contaminated product in an aqueous bath under washing condition such that the at least one product does not become soluble; and (b) disposing of the at least one contaminated product in an aqueous bath under condition such that at least a portion of the product becomes soluble. The method produces a reusable product after washing step (a), and disposes of the reusable product after disposal step (b). The method reduces the amount of radioactive waste by (1) eliminating the volume of radioactive waste associated with conventional reusable products, such as cotton or cotton blend coveralls, which must be disposed of by burying the waste, and/or (2) eliminating the volume of radioactive waste associated with single-use water-soluble products, such as insoluble components (i.e., zippers, thread, etc.), which must also be disposed of by burying the waste.

The methods of reducing an amount of radioactive waste generated by at least one contaminated product may comprise any of the above-described method steps associated with washing the product, and disposing of the components of the product. Desirably, the method comprises two or more washing steps (a), and as many as about 20 washing steps (a). In one embodiment of the present invention, the method comprises up to about 10 washing steps (a).

As described above, each of the washing steps (a) independently has a desirable bath temperature of less than about 90° C., in some cases, less than about 75° C., in other cases, less than about 50° C., and in other cases, less than about 37° C. In addition to Water, each of the washing steps (a) independently contains one or more surfactants detergents or other cleaning agents.

In the disposal step, disposal step (b) desirably has a bath temperature of greater than about 37° C., in some cases, greater than about 50° C., in other cases, greater than about 75° C., and in other cases, greater than about 90° C. In addition to water, the disposal step (b) may contain one or more degradation-enhancing reactants, a precursor of a degradation-enhancing reactant, oxidizers, such as ozone, or a combination thereof as described above.

The method of reducing an amount of radioactive waste generated by at least one contaminated product may be used for any products including, but not limited to, fibers, fabrics, films, nonwoven fabrics, woven fabrics; knitted fabrics, garments, protective clothing, coveralls, booties, face masks, gloves, apparel, linens, drapes, towels, laminates containing at least one fabric or film, sponges, mop heads, webs, bags, gauzes, pads, wipes, pillows, bandages, or any combination thereof. The method is particular useful when the at least one contaminated product comprises one or more multiple-use coveralls comprising water-soluble material as described above, especially multiple-use coveralls comprising polyvinyl alcohol with or without acetyl groups, cross-linked or uncross-linked.

The method is suitable for reducing the amount of radioactive waste generated by at least one contaminated product, wherein the at least one contaminated product is contaminated with radioactive material including, but not limited to, a transuranic element, a fission product, a natural radioactive element, an activation product from a nuclear process, a medical isotope, or a combination thereof.

In one desired embodiment of the present invention, the method of reducing an amount of radioactive waste generated by at least one contaminated product comprises the following steps:

(a) washing the at least one contaminated product in an aqueous bath under washing condition such that the at least one product does not become soluble;
(b) extracting excess water from the washed product;
(c) drying the washed product;
(d) monitoring the dried product for the presence of one or more radioactive materials;
(e) using the washed product for a particular purpose, wherein the particular purpose exposes the product to one or more radioactive materials;
(f) washing the at least one contaminated product in an aqueous bath under washing condition such that the at least one product does not become soluble;
(g) extracting excess water from the washed product;
(h) drying the washed product;
(i) monitoring the dried product for the presence of one or more radioactive materials;
(j) repeat steps (e)–(j) for a desired number of times (typically less than 20) finishing with either step (e) (i.e., at least one contaminated product) or with step (f) or (i) (i.e., a washed product);
(k) placing the multiple-use product from step (j) into a disposal reactor;
  (k1) introducing water into the reactor to form an aqueous solution;
  (k2) adding one or more components to the reaction vessel including, but not limited to, a degradation-enhancing reactant, a precursor to a degradation-enhancing reactant, an oxidizer, such as ozone, or a combination thereof;
  (k3) heating the aqueous solution so as to react the precursor to form the degradation-enhancing reactant, if necessary, and reacting with the water-soluble polymer to form degradation products;
(l) filtering non-solubilized material from the aqueous solution;
(m) optionally, measuring a parameter indicator of the concentration of polymer material in the aqueous solution;
(n) separating radioactive material from the aqueous solution by a separation technique, such as by filtering;
(o) collecting the radioactive material for proper disposal;
(p) optionally, altering or neutralizing the pH of the aqueous solution substantially free of radioactive material;
(q) biodegrading the resulting degradation products in the aqueous solution substantially free of radioactive material, e.g., organic acids form $CO_2$, $H_2O$ and biomass; and
(r) removing any insoluble components from the reactor.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Release Data Comparison Between Cotton/Polyester Blend Fabrics and OREX™ PVA Fabrics Contamination release testing was conducted at an Eastern Technologies, Inc. (ETI) facility in Ashford, Ala. ETI is one of a limited number of commercial laundry vendors, which service the U.S. commercial nuclear industry. The tests were performed to determine the relative "release" characteristics between standard 65/35 cotton/polyester blend fabrics and OREX™ 65 grams per square meter (gsm) nonwoven, non-treated, polyvinyl alcohol based fabrics. The industry currently uses reusable cotton/polyester blend fabrics in personal protective clothing. The "contaminants" used in this test were radioactive surface contaminants typical of that common to nuclear fission fuel cycle facilities. The contaminants used were primarily in solid or particulate form. Some soluble forms were present as well (i.e., Cesium-137, 134). The ETI laundry process is used to (a) decontaminant garments and then (b) filter the contaminants from the process water. These filter deposits were used as the contaminant source for this study. The test patches were highly contaminated, which correlates to several millions dpm (disintegrations per minute). (Most protective garments will never ever get that contaminated in practice.)

Several swatches of 65/35 blend fabric and OREX™ 65 gsm fabric (cut from real coveralls) were used. The swatches measured approximately 0.15 $m^2$ each. The fabric swatches were contaminated with the filter deposits. The deposits had a consistency of moist sludge. The sludge was worked into the fabric swatches using moderate hand pressure to replicate field conditions of human contact with surface contamination.

The contaminated fabric swatches were then analyzed on gamma spectroscopy equipment located at the ETI facility. The gamma spectroscopy system consisted of a 5.1 cm (2 inches)×5.1 cm (2 inches) NaI detector mounted in a shielded sample cave. The detector was coupled to a Canberra Industries multi-channel analyzer, configured using Canberra's Genie 2000 software. All samples were analyzed using a counting geometry calibrated for analysis of 1 liter soil samples. Contamination reduction factors were derived from the analysis data, providing accurate relative results between the two types of samples.

Each fabric sample was analyzed both prior to and after washing (decontamination). The decontamination process was completed by performing a normal wash cycle in one of ETI's commercial washing machines. Both types of swatches were washed simultaneously in the same machine in each trial. The machine was a Milnor commercial washing machine available from Pellerin Milnor Corporation (Kenner, La.). Water temperature was 15° C. Following the final spin cycle, the fabric samples were centrifuged at about 200 to 212 g's for about 2–4 minutes, and then dried at a temperature of about 60° C. (140° F.) in a commercial dryer available from Cissell Manufacturing Company (Louisville, Ky.) for about 30 minutes Fabric samples were contaminated with enough radioactive material so that the swatches after washing would have at least a lower level of detectability (LLD) detectable by the above-described detector. From the before and after values, accurate decontamination factors (DF's) were determined.

Fabric samples were tested using the above-described detector and counted for 60 minutes to determine radioactivity concentrations present (i.e., fabric swatches were mounted in the shielded sample cave for 60 minutes). The results are shown in Table 1 below.

TABLE 1

Release Data For 60 Minute Counting Times

| Substrate | Isotope | Before | After | DF |
|---|---|---|---|---|
| Cloth | Mn-54 | 6.10E+5 | 3.52E+4 | 17 |
| OREX ™ | Mn-54 | 3.51E+5 | 5.71E+2 | 615 |
| Cloth | Co-58 | 6.13E+5 | 3.54E+2 | 17 |
| OREX ™ | Co-58 | 3.53E+5 | 5.74E+2 | 615 |
| Cloth | Co-60 | 1.08E+6 | 6.54E+4 | 17 |
| OREX ™ | Co-60 | 5.82E+5 | 1.62E+3 | 359 |
| Cloth | Cs-134 | 1.30E+5 | 7.38E+3 | 18 |
| OREX ™ | Cs-134 | 8.37E+4 | <LLD | >36 |

Note:
(1) activity: pCi/gm,

As seen in Table 1, the comparative data demonstrates the following surprising improvement over conventional reusable cotton/polyester blend coveralls:

(1) Decontamination factors for 65/35 blend fabric are on the order of 17–20. In other words, post-wash activity is about 1/20th of pre-wash activity.

(2) Decontamination factors for 65 gsm OREX™ were greater than 600. In other words, at least 99.8% of the radioactivity is removed during the wash.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. Scrubs comprising water-soluble nonwoven fabric formed from water-soluble polyvinyl alcohol fibers. wherein the scrubs comprise at least 50 parts by weight of the water-soluble polyvinyl alcohol fibers, based on a total weight of the scrubs, wherein the scrubs are capable of being washed in an aqueous bath without negatively impacting the structural integrity of the scrubs.

2. The scrubs of claim 1, wherein the scrubs comprise (i) a smock-like, shirt having a V-neck, sleeves, and up to about six pockets, and (ii) a pair of pants having pant legs, and up to about four pockets.

3. The scrubs of claim 2, wherein the scrubs comprise short sleeves and long pant legs.

4. The scrubs of claim 2, wherein the scrubs comprise long sleeves and long pant legs.

5. The scrubs of claim 1, wherein the scrubs further comprise at least one colorant to provide a desired color.

6. The scrubs of claim 5, wherein the desired color is blue or green.

7. The scrubs of claim 1, wherein the water-soluble nonwoven fabric is pre-washed or pre-shrunk.

8. Scrubs comprising water-soluble spunlaced nonwoven fabric formed from water-soluble polyvinyl alcohol fibers, wherein the scrubs comprise at least 50 parts by weight (pbw) of said water-soluble polyvinyl alcohol fibers, based on a total weight of the scrubs, wherein the scrubs are capable of being washed in an aqueous bath without negatively impacting the structural integrity of the scrubs.

9. The scrubs of claim 8, wherein the scrubs comprise (i) a smock-like, shirt having a V-neck, sleeves, and up to about six pockets, and (ii) a pair of pants having pant legs, and up to about four pockets.

10. The scrubs of claim 8, wherein the scrubs comprise at least 90 parts by weight (pbw) of water-soluble fibers, based on a total weight of the scrubs.

11. The scrubs of claim 8, wherein the scrubs are launderable, multi-use scrubs.

12. Scrubs capable of being decontaminated of radioactive material using a washing step, said scrubs comprising water-soluble nonwoven fabric formed from water-soluble polyvinyl alcohol fibers, wherein the scrubs comprise at least 50 parts by weight of the water-soluble polyvinyl alcohol fibers, based on a total weight of the scrubs, wherein the scrubs are capable of being washed in an aqueous bath without negatively impacting the structural integrity of the scrubs.

13. The scrubs of claim 12, wherein the scrubs comprise (i) a smock-like, shirt having a V-neck, sleeves, and up to about six pockets, and (ii) a pair of pants having pant legs, and up to about four pockets.

14. The scrubs of claim 12, wherein the scrubs comprise at least 90 parts by weight of water-soluble polyvinyl alcohol fibers, based on a total weight of the scrubs.

15. The scrubs of claim 1, wherein after the scrubs are (i) exposed to one or more radioactive materials at an exposure level of at least 1,000,000 disintegrations per minute as measured by an automatic laundry monitor and (ii) subsequently washed, the washed scrubs have a contamination level of less than 5,000 disintegrations per minute as measured by the same automatic laundry monitor.

16. The scrubs of claim 8, wherein after the scrubs are (i) exposed to one or more radioactive materials at an exposure level of at least 1,000,000 disintegrations per minute as measured by an automatic laundry monitor and (ii) subsequently washed, the washed scrubs have a contamination level of less than 5,000 disintegrations per minute as measured by the same automatic laundry monitor.

17. The scrubs of claim 8, wherein the scrubs comprise two or more spunlaced nonwoven fabric sheets joined to one another with one or more sheet fastening devices.

18. The scrubs of claim 12, wherein after the scrubs are (i) exposed to one or more radioactive materials at an exposure level of at least 1,000,000 disintegrations per minute as measured by an automatic laundry monitor and (ii) subsequently washed, the washed scrubs have a contamination level of less than 5,000 disintegrations per minute as measured by the same automatic laundry monitor.

19. The scrubs of claim 1, wherein the scrubs are single-use scrubs.

20. The scrubs of claim 8, wherein the scrubs are single-use scrubs.

* * * * *